US006612507B1

(12) United States Patent
Meyer et al.

(10) Patent No.: US 6,612,507 B1
(45) Date of Patent: Sep. 2, 2003

(54) MULTI-FUNCTION SINK WATER SPRAYING APPARATUS

(76) Inventors: Sandra D. Meyer, P.O. Box 114, Princeton, KS (US) 66078; Ryan E. Meyer, P.O. Box 114, Princeton, KS (US) 66078; Tyler Harrell, P.O. Box 418, Ottawa, KS (US) 66067

( * ) Notice: Subject to any disclaimer, the term of this patent is extended or adjusted under 35 U.S.C. 154(b) by 0 days.

(21) Appl. No.: 10/173,920

(22) Filed: Jun. 18, 2002

(51) Int. Cl.[7] ..... A62C 31/02

(52) U.S. Cl. ..... 239/394; 239/390; 239/526; 239/436

(58) Field of Search ..... 239/390, 391, 239/393, 394, 397, 525, 526, 436, 437, 440, 442, 443, 447, 25, 289, 587, 579; 401/268, 139, 289, 6, 25, 137

(56) References Cited

U.S. PATENT DOCUMENTS

| | | | | | |
|---|---|---|---|---|---|
| 1,819,157 | A | * | 8/1931 | Fitter | 401/286 |
| 2,807,816 | A | * | 10/1957 | O'Brien | 401/15 |
| 4,171,169 | A | | 10/1979 | Williams | |
| 4,618,100 | A | * | 10/1986 | White et al. | 239/440 |
| 4,662,768 | A | | 5/1987 | Gottwald et al. | |
| 4,761,839 | A | | 8/1988 | Ganaway | |
| 4,812,070 | A | * | 3/1989 | Marty | 401/289 |
| 4,903,897 | A | * | 2/1990 | Hayes | 239/394 |
| 5,090,624 | A | * | 2/1992 | Rogers | 239/381 |
| 5,316,401 | A | | 5/1994 | Sears | |
| 5,873,531 | A | * | 2/1999 | Wang | 239/394 |
| 6,000,626 | A | * | 12/1999 | Futo et al. | 239/74 |
| 6,019,537 | A | | 2/2000 | Hunt | |
| 6,035,477 | A | * | 3/2000 | Robert | 15/29 |
| 6,070,278 | A | | 6/2000 | Smith | |
| 6,164,566 | A | * | 12/2000 | Hui-Chen | 239/394 |
| 6,230,989 | B1 | * | 5/2001 | Haverstraw et al. | 239/443 |
| 6,341,737 | B1 | * | 1/2002 | Chang | 239/394 |

* cited by examiner

*Primary Examiner*—Gregory L. Huson
*Assistant Examiner*—Amanda Flynn
(74) *Attorney, Agent, or Firm*—Dale J. Ream

(57) ABSTRACT

A sink water spraying apparatus includes a sprayer housing having a channel extending between inlet and outlet ports. The housing includes a trigger for actuating water flow. A pulsation selector disc is rotatably coupled to the housing and defines a hole that may be selectively aligned with the outlet port. A pulsation assembly is connected to a shaft extending from the housing and may receive a water stream flowing through the pulsation selector disc. The pulsation assembly includes a rotor for repetitively disrupting this flow so as to make it pulsate. A pattern selector disc is releasably coupled to the pulsation selector disc and defines differently configured nozzle ports. The pattern selector disc may be rotated such that a water stream received from the pulsation assembly may be conveyed in a desired pattern. An auxiliary cleaning attachment may be releasably coupled to the pattern selector disc.

19 Claims, 9 Drawing Sheets

MULTI-FUNCTION SINK WATER SPRAYING APPARATUS

BACKGROUND OF THE INVENTION

This invention relates generally to sink water sprayers and, more particularly, to a multi-function sink water sprayer that can selectively cause a water stream to pulsate, cause the water stream to be delivered in a selected pattern, and utilize a selected auxiliary cleaning attachment.

Modern kitchen sink systems include a sprayer connected to a hose such that the sprayer may be extended and actuated to rinse dishes or the like. The primary usefulness of a conventional sink sprayer is its directional discharge ability. However, additional cleaning devices are frequently needed for use in conjunction with a sink sprayer in order to sufficiently remove dried food from dishes prior to washing them or loading them into a dishwasher. The existing devices do not provide a water sprayer that is capable of accomplishing the variety of uses encountered at a kitchen sink environment.

Therefore, it is desirable to have a multi-functional sink water spraying apparatus that enables a user to selectively cause a water stream to pulsate. Further, it is desirable to have a water spraying apparatus that enables a user to select a desired water stream output pattern. In addition, it is desirable to have a water spraying apparatus having selectable quick-connect cleaning attachments.

SUMMARY OF THE INVENTION

Accordingly, a multi-functional sink water spraying apparatus according to the present invention includes a sprayer housing having a generally hollow interior with upstream and downstream ends. An inlet port at the upstream end is capable of being attached to a hose for supplying water to the apparatus. A main channel extends between the upstream and downstream ends. More particularly, an upper and lower channel may be connected to the main channel and the downstream end may include respective upper and lower outlet ports. A trigger is coupled to the sprayer housing for actuating a water stream to flow through the main channel. A pulsation selector disc is rotatably mounted to the downstream end of the sprayer housing and defines a hole that may be selectively aligned with either the upper ("pulsation configuration") or lower ("standard configuration") outlet port. A shaft extends outwardly from the downstream end and through the pulsation selector disc. A rotor assembly is connected to the shaft for repetitively interrupting a water stream flowing through the pulsation selector disc hole when the hole is positioned at the pulsation configuration. However, at the standard configuration, pulsation is avoided.

A water pattern selector disc is rotatably coupled to the pulsation selector disc and includes a plurality of nozzle ports of different configurations. Therefore, the pattern selector disc may be rotated by a user such that water received from the pulsation selector disc (via the rotor assembly) is output through a selected nozzle port. The pattern selector disc includes a hub. The water spraying apparatus includes a plurality of cleaning attachments, each cleaning attachment having a shaft that may be releasably coupled to the hub. Therefore, a user may select the cleaning attachment, water stream pattern, and pulsation setting that is most appropriate for a particular cleaning task.

Therefore, a general object of this invention is to provide a multi-function sink water spraying apparatus for use in cleaning dishes having various degrees of cleaning requirements.

Another object of this invention is to provide a water spraying device, as aforesaid, in which a user may select whether a water stream will pulsate.

Still another object of this invention is to provide a water spraying device, as aforesaid, in which a user may select an outflow water pattern.

Yet another object of this invention is to provide a water spraying device, as aforesaid, having a trigger-action water actuator means.

A further object of this invention is to provide a water spraying device, as aforesaid, in which auxiliary cleaning attachments may be interchangeably coupled to the apparatus.

A still further object of this invention is to provide a water spraying device, as aforesaid, which may selectively dispense soap during operation.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
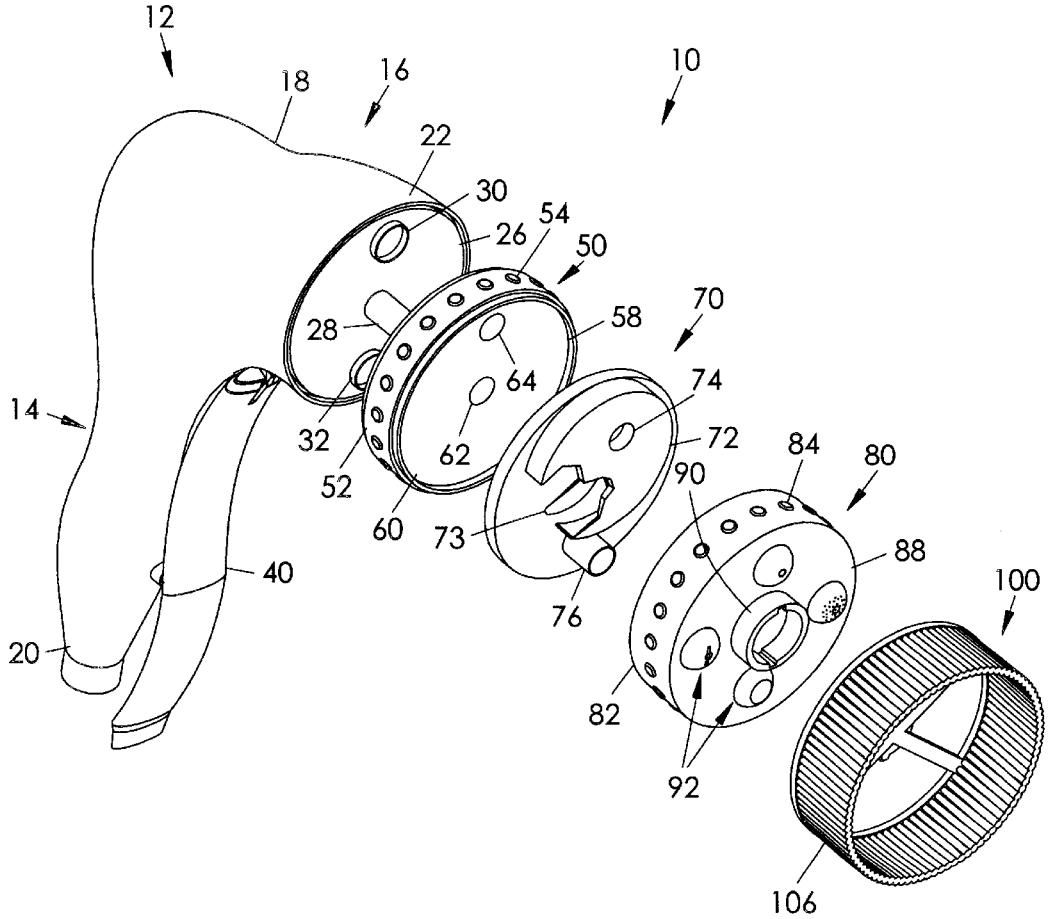
FIG. 1 is an exploded perspective view of a sink water spraying apparatus according to a preferred embodiment of the present invention.
Figure 2:
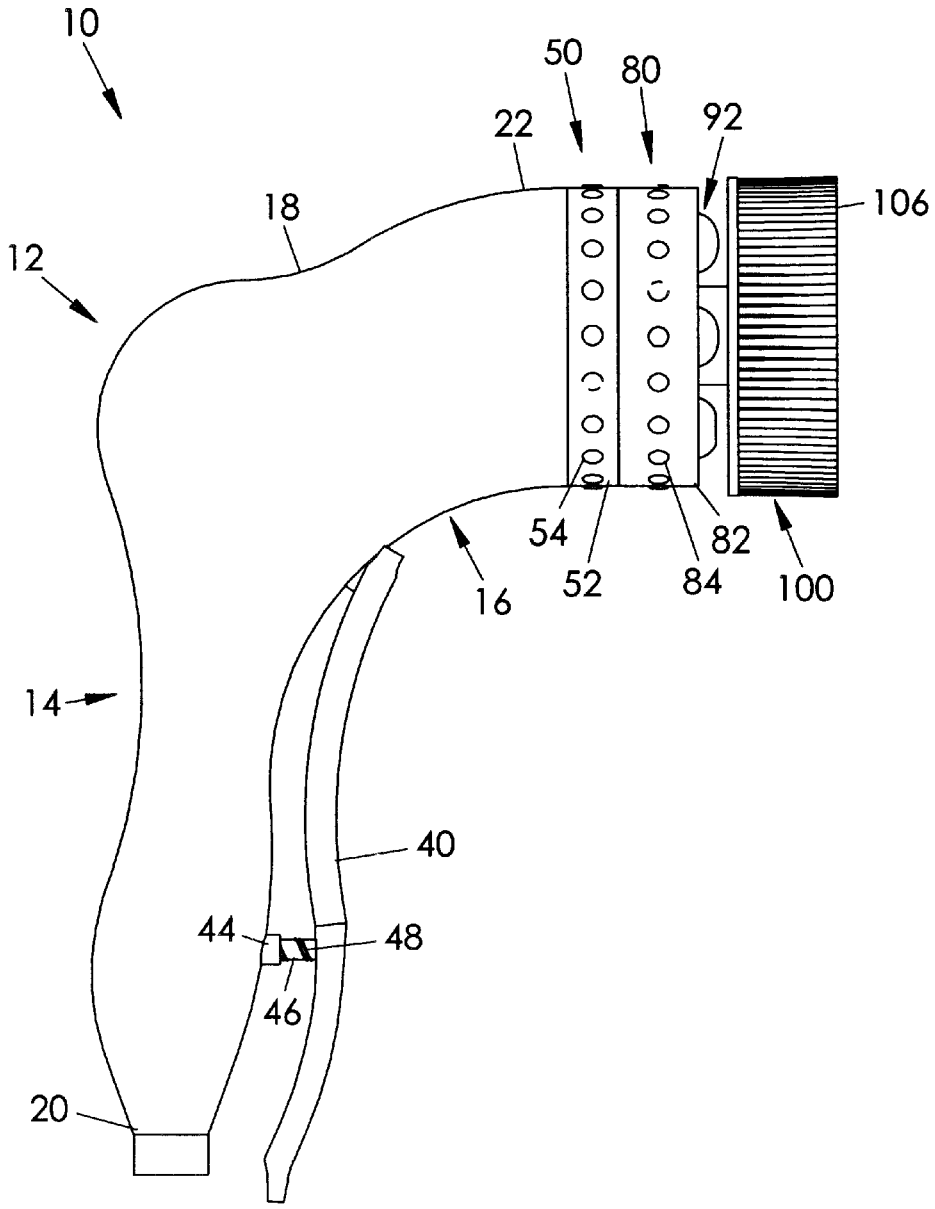
FIG. 2 is a side view of the apparatus as in FIG. 1.

A multi-function sink water spraying apparatus according to the present invention will now be described with reference to FIGS. 1 through 9 of the accompanying drawings. The sink water spraying apparatus 10 includes a sprayer housing 12 having a pistol-grip type handle section 14 integrally connected to a body section 16. The exterior of the sprayer housing 12 includes an ergonomic configuration. More particularly, the exterior of the body section 16 includes a top wall 18 having a tapered configuration that is suitable for receiving a user's thumb when gripping the handle section 14. This configuration enables a user to exert downward pressure when using the apparatus for cleaning, as will be described more fully later. The sprayer housing 12 includes upstream 20 and downstream 22 ends and defines a generally hollow interior space.

Figure 8:
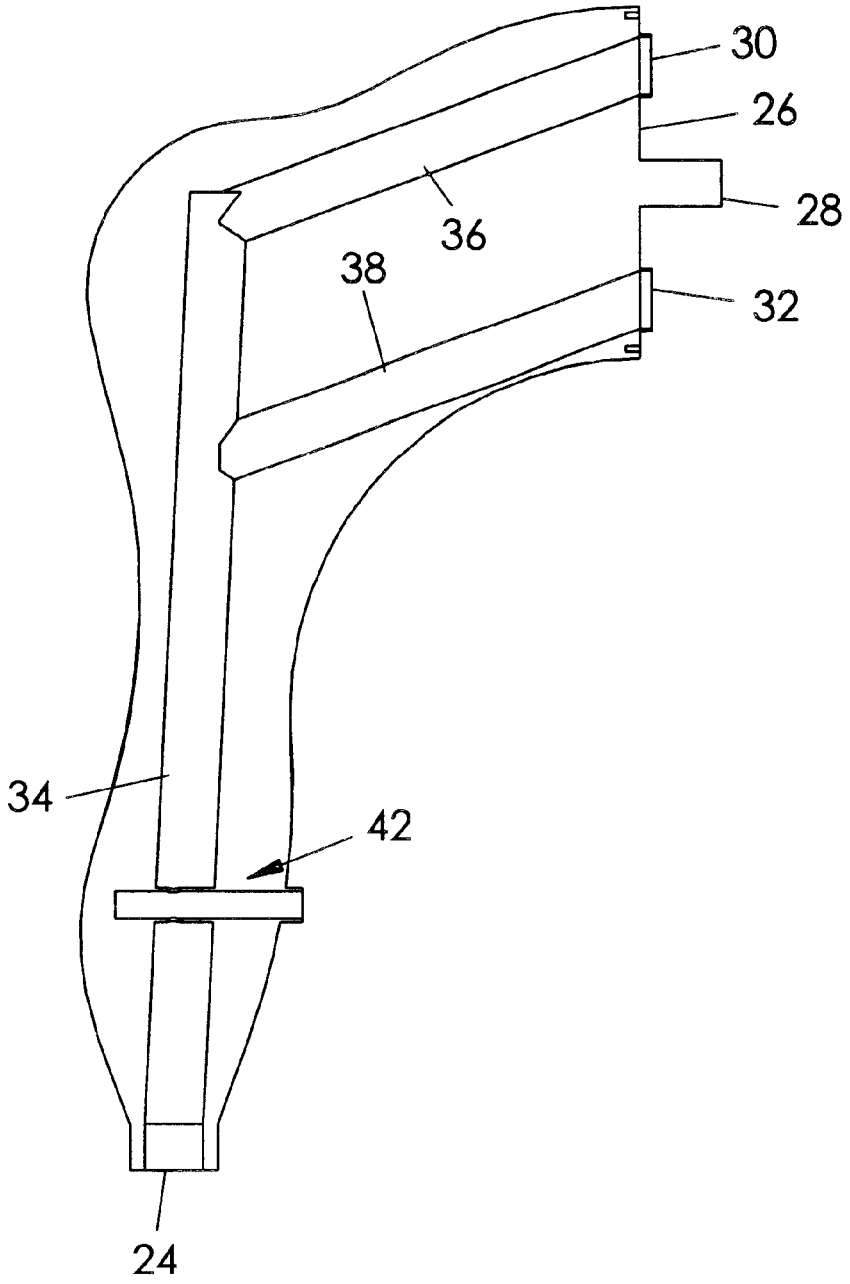
FIG. 8 is a fragmentary view of a sprayer housing as in FIG. 2 with a side of the sprayer housing and the selector discs removed.

A bottom wall of the handle section 14 defines an inlet port 24 that is capable of being attached to a water supply hose. The downstream end 22 of the body section 16 of the sprayer housing 12 includes an end wall 26 defining spaced apart upper 30 and lower 32 outlet ports (FIG. 8). A shaft 28 is fixedly attached to the end wall 26 and extends generally perpendicularly therefrom. A main channel 34 is positioned within the interior space of the sprayer housing 12 and extends from the inlet port 24 into the body section 16. Upper 36 and lower 38 channels are connected to the main channel 34 in the body section 16 and interconnect the main channel 34 with upper 30 and lower 32 outlet ports (FIG. 8). It is understood, however, that having only a single channel and single outlet port would also work, as to be described more fully later.

Figure 5:
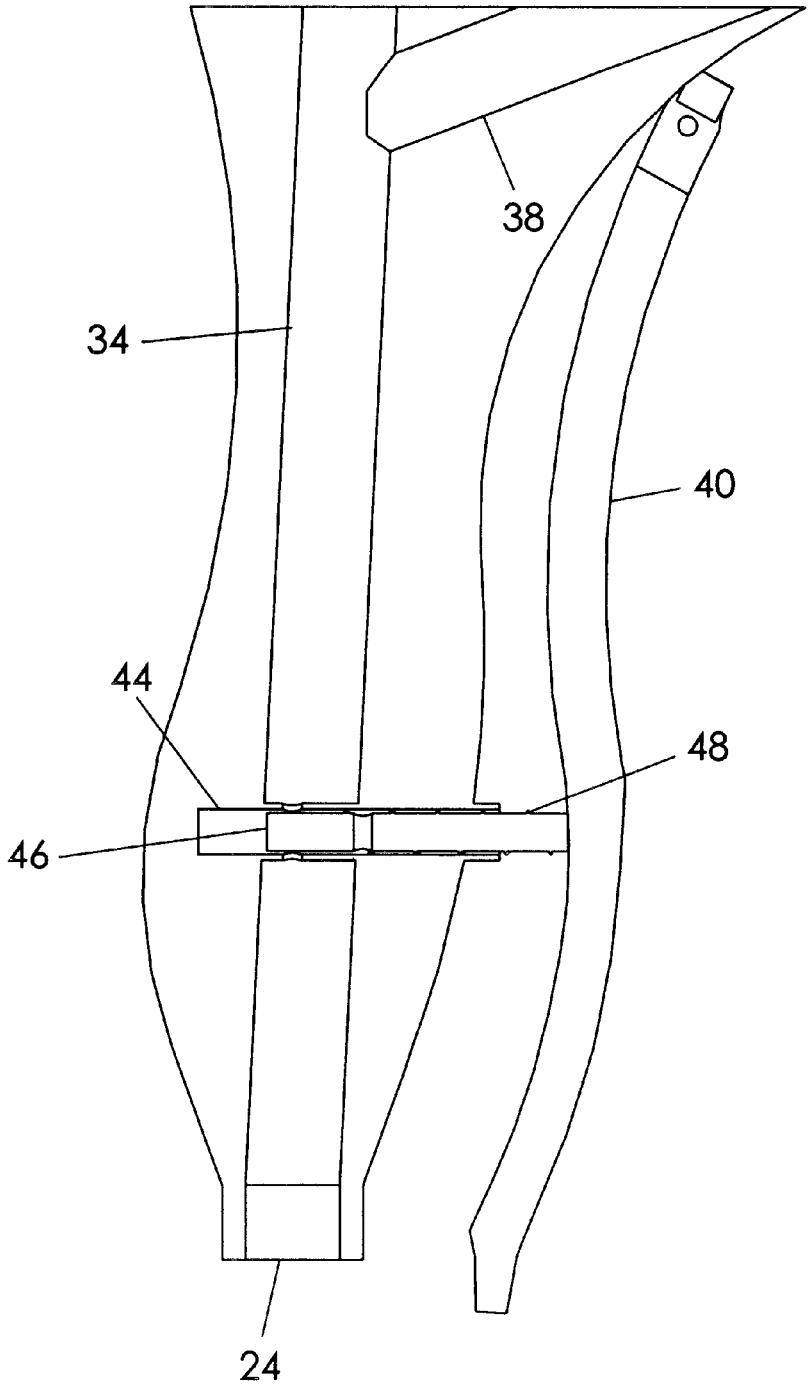
FIG. 5 is a sectional view as in FIG. 4 with the valve in a closed configuration.

An elongate trigger handle 40 is pivotally attached to a front side of the sprayer housing 12 and operable in a pistol trigger manner. A valve 42 for regulating water flow is positioned within the main channel 34 and is operable by operation of the trigger handle 40. More particularly, the valve 42 includes an outer shaft 44 and an inner shaft 46 slidably receivable by the outer shaft 44. The inner shaft 46 is attached to the trigger handle 40 so that depression of the trigger handle 40 causes the inner shaft 46 to be inserted into the outer shaft 44 (FIG. 5). The inner shaft 46 is biased in an outward direction by a compression spring 48 connected thereto. Thus, the inner shaft 46 urges the trigger handle 40 toward a released configuration. The inner and outer shafts include through-holes that allow water to flow through the main channel 34 when the inner shaft 46 is fully inserted into the outer shaft 44, i.e. when the trigger handle 40 is fully depressed (FIG. 4) but not when the inner shaft 46 is partially released (FIG. 5). Of course, proper sealing may be further maintained with O-rings positioned about the through-holes.

The sink water spraying apparatus 10 includes a pulsation selector disc 50 having a generally circular configuration. The pulsation selector disc 50 includes a continuous radial side wall 52 having a plurality of nubs 54 thereon such that the pulsation selector disc 50 may be easily gripped by a user. A rear edge of the radial side wall 52 forms a rim 56 (FIG. 9) having a configuration complementary to a corresponding receiving structure on the end wall 26 of the sprayer housing 12 for releasable tongue and groove attachment. A front edge of the radial side wall 52 also includes a rim 58 configured for tongue and groove attachment as to be described more fully below. A front wall 60 extends between the front rim such that the front of the pulsation selector disc 50 is generally closed. However, the pulsation selector disc 50 defines an axial bore 62 through the front wall 60 through which the shaft 28 may extend.

The pulsation selector disc 50 further defines another hole 64 spaced from the axial bore 62. The pulsation selector disc 50 is rotatable by a user relative to the downstream end 22 when coupled thereto such that the pulsation selector disc hole 64 may be selectively aligned with the upper 30 or lower 32 outlet port. A plug is fixedly attached to the inside surface of the front wall of the pulsation selector disc 50 opposite the hole 64 and is configured to cover and seal the "unselected" outlet port. In other words, if the pulsation selector disc 50 is rotated to align the hole 64 with the upper outlet port 30 (the "pulsation configuration"), the plug is correspondingly positioned to seal the lower outlet port 32. Conversely, if the pulsation selector disc 50 is rotated to align the hole 64 with the lower outlet port (the "standard configuration"), the plug is correspondingly positioned to seal the upper outlet port 30.

The sink water spraying apparatus 10 further includes a rotor disc 70 (FIG. 9) releasably coupled to a free end of the shaft 28. Thus, the rotor disc 70 is held in a stationary configuration even when the pulsation selector disc 50 is rotated. The rotor disc 70 includes a rotor assembly having a chamber 72 defining oppositely disposed upper inlet (not shown) and outlet 74 openings. A rotor having a plurality of blades 73 is mounted within the chamber 72, the rotor blades being configured to cause the rotor to rotate when a water stream is conveyed through the chamber 72 between the inlet and outlet 74 openings. As the rotor blades 73 repetitively interrupt the water stream, the water stream is caused to pulsate as it passes through the rotor chamber 72. Therefore, when the pulsation selector disc 50 is at the pulsation configuration, a water stream flowing from the upper outlet port 30 of the sprayer housing 12 passes through the pulsation selector disc hole 64 and rotor disc chamber 72 and ultimately exits the chamber outlet opening 74.

Figure 9:
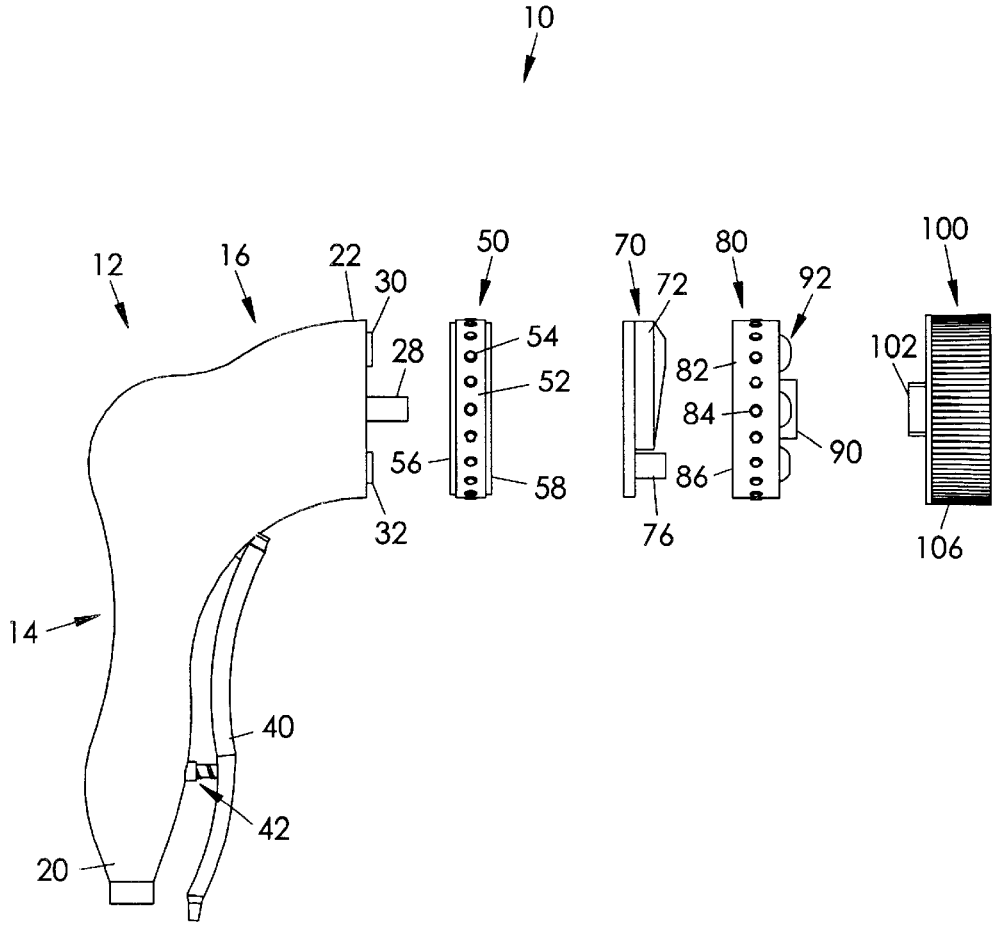
FIG. 9 is an exploded view of the apparatus as in FIG. 2.

The rotor disc 70 also includes a tubular channel 76 extending through a lower portion of the rotor disc 70 in axial alignment with the lower outlet port 32 of the sprayer housing downstream end 22 (FIGS. 1 and 9). Thus, when the pulsation selector disc hole 64 is aligned with the lower outlet port 32, the water stream is merely passed through the rotor disc 70 with no pulsation.

Figure 3:
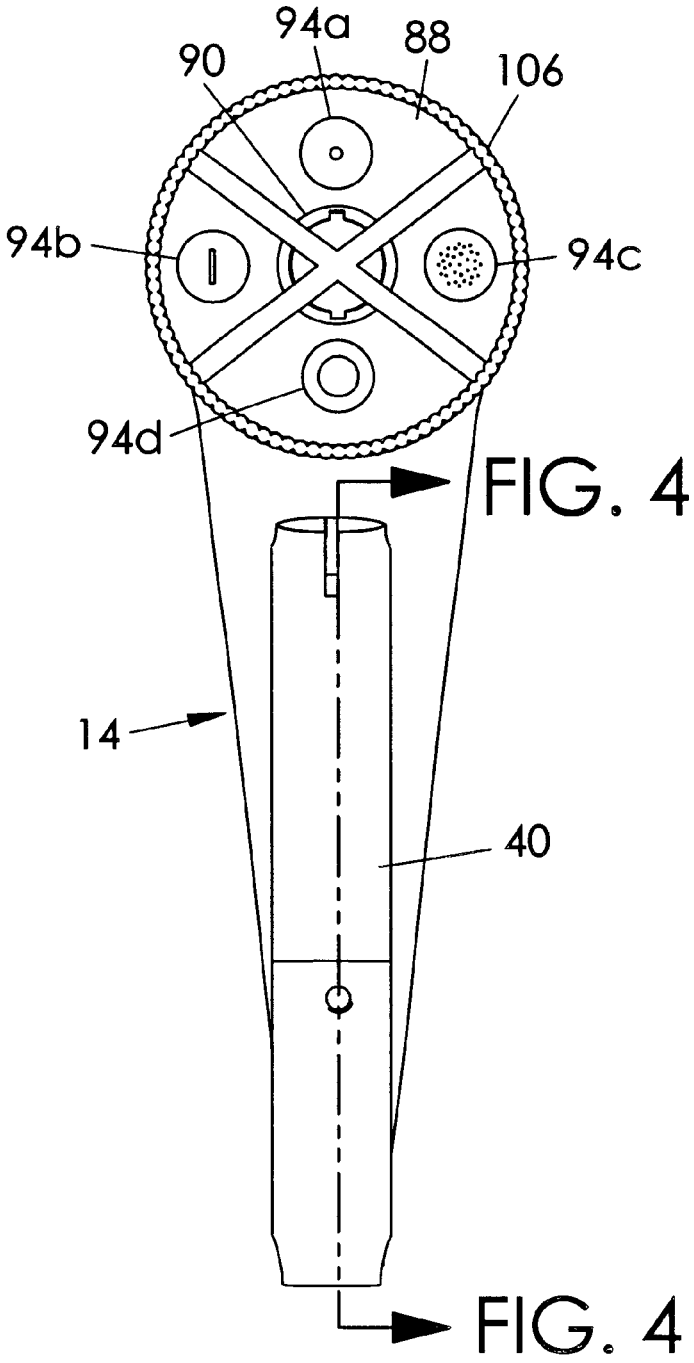
FIG. 3 is a front view of the apparatus as in FIG. 2.
Figure 4:
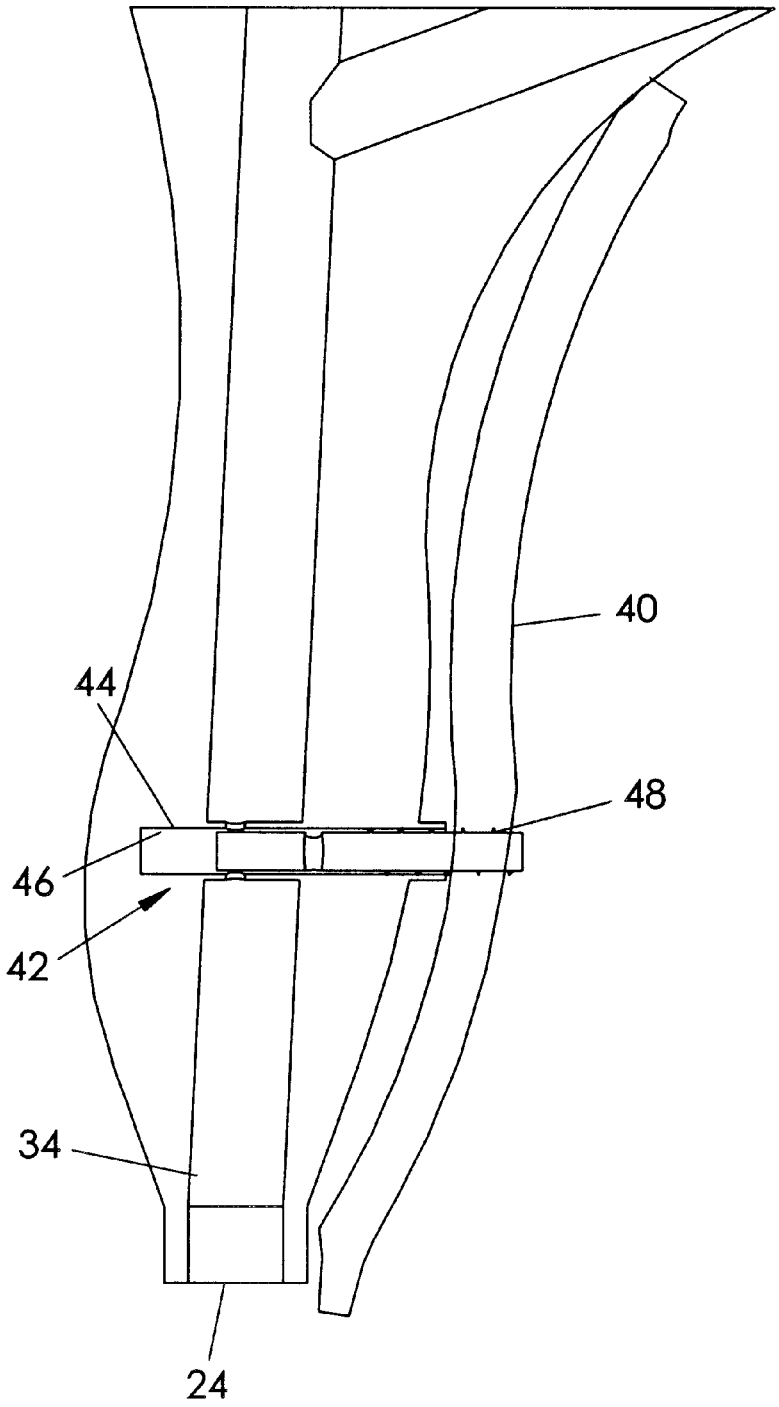
FIG. 4 is a sectional view taken along line 4—4 of FIG. 3 with a valve in an open configuration.

The sink water spraying apparatus 10 further includes a pattern selector disc 80. The pattern selector disc 80 includes a continuous radial side wall 82 having a plurality of nubs 84 for enhancing a user's grip thereabout (FIG. 9). A rear edge 86 of the pattern selector disc 80 includes a configuration capable of receiving the front rim 58 of the pulsation selector disc 50 in a releasable tongue and groove/snap-fit relationship. It is understood, however, that the pattern selector disc 80 is able to be rotated while coupled to the pulsation selector disc 50. The pattern selector disc 80 includes a front wall 88 which encloses the front thereof but has an open back. The rotor disc 70 is configured so as to be situated within the pattern selector disc 80 when the pattern selector disc 80 is coupled to the pulsation selector disc 50. The front wall 88 of the pattern selector disc 80 includes a plurality of nozzle ports 92 (FIGS. 3 and 9), each nozzle port having a configuration different from a configuration of any of the other nozzle ports 92. For example, the nozzle ports 92 may be configured to provide a high velocity spray 94*a*, flat spray 94*b*, shower spray 94*c*, or wide stream spray 94*d* (FIG. 3). It should be appreciated that when coupled to the pulsation selector disc 50, the desired nozzle port 92 must be rotated into alignment with the appropriate port selected by the pulsation selector disc 50. In other words, if the pulsation selector disc 50 is in the pulsation configuration, then the water stream will be flowing through the outlet opening 74 of the rotor chamber 72 and the desired nozzle port 92 must be aligned therewith by appropriately rotating the pattern selector disc 80.

Figure 6A:
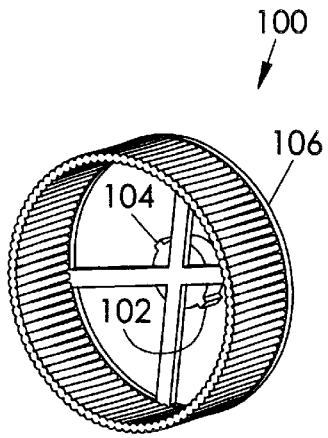
FIG. 6*a* is one cleaning attachment for use with the water spraying apparatus.
Figure 6B:
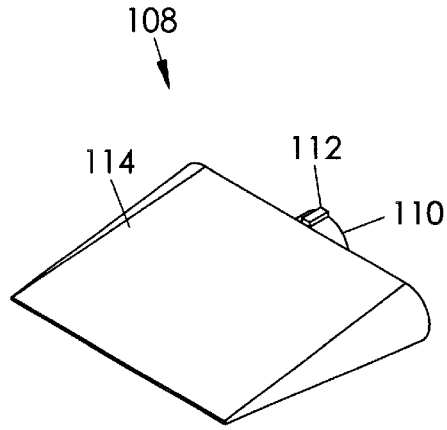
FIG. 6*b* is another cleaning attachment for use with the water spraying apparatus.
Figure 6C:
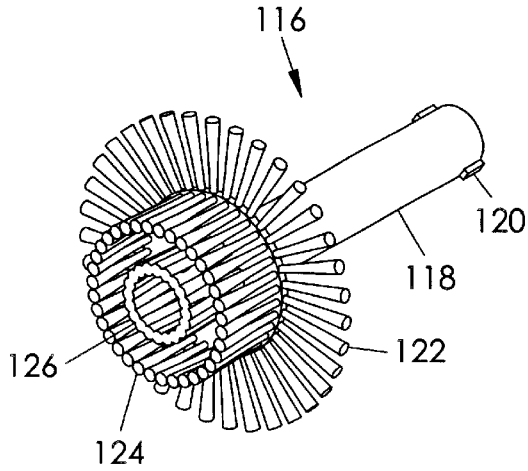
FIG. 6*c* is still another cleaning attachment for use with the water spraying apparatus.
Figure 7:
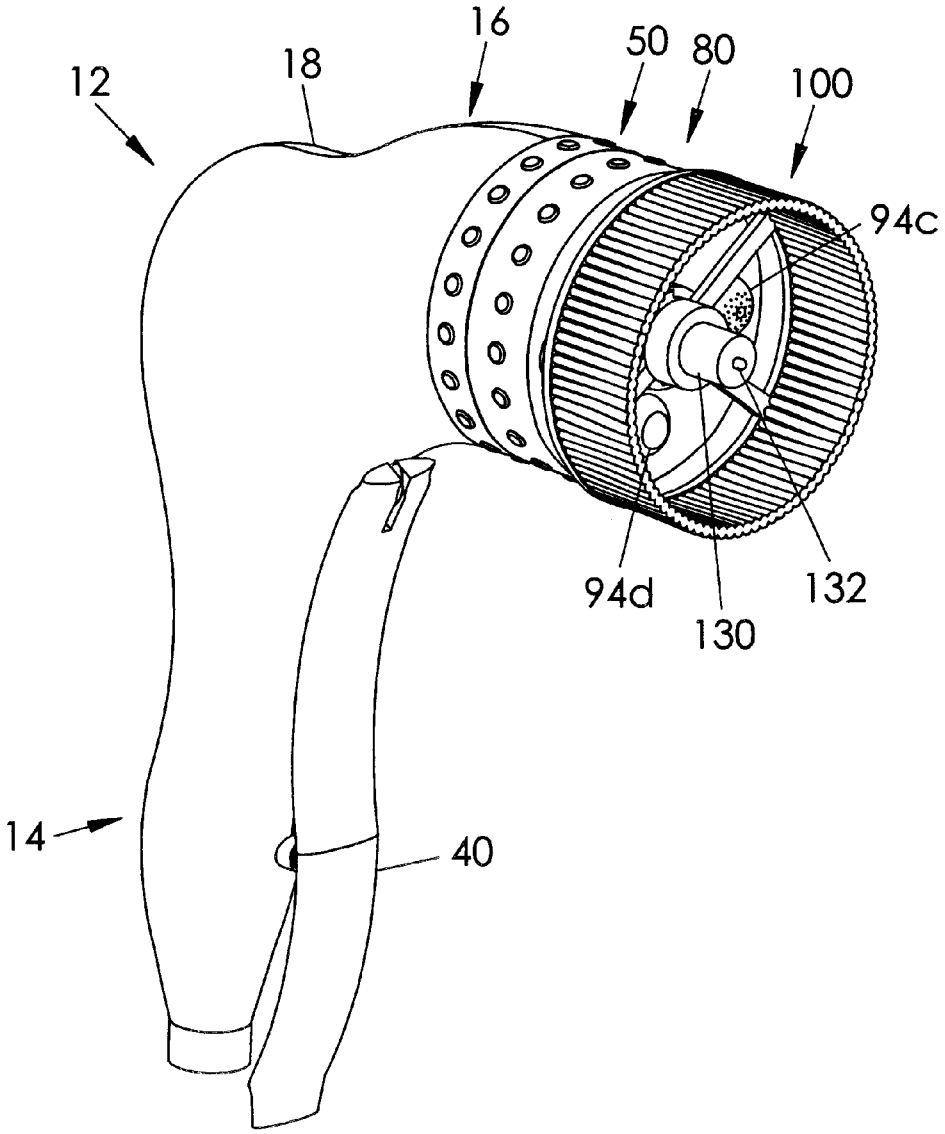
FIG. 7 is a perspective view of the water spraying apparatus as in FIG. 1 in use with a cleaning attachment having a soap dispenser.

The sink water spraying apparatus 10 further includes a plurality of auxiliary cleaning attachments 100, 108, 116 with each attachment having a cleaning implement suitable for a particular cleaning task (FIGS. 6*a*–6*c*). Each auxiliary cleaning attachment 100, 108, 116 includes a shafts 102, 110, 118 having quick-connect flanges 104, 112, 120, respectively, for snap-fit attachment to a hub 90 on the front wall 88 of the pattern selector disc 80. More particularly, the cleaning attachment 100 shown in FIG. 6*a* includes a brush 106 having a plurality of diametrically arranged bristles. The cleaning attachment 108 shown in FIG. 6*b* includes a blade or scraper 114 configuration. The cleaning attachment 116 shown in FIG. 6*c* includes an elongate shaft 118 with a set of radially extending bristles 122 and concentric bristles 124, 126. This cleaning attachment 116 is particularly suited for cleaning glasses or other containers having a tubular configuration. As shown particularly in FIG. 7, a soap dispenser 130 may be centrally mounted to an auxiliary cleaning attachment. Preferably, the soap dispenser 130 includes a pressure release nozzle 132 for dispensing soap. The soap dispenser 130 may also be removable for refilling. Of course, cleaning attachments having other configurations would also be suitable.

In use, the inlet port 24 of the sprayer housing 12 may be connected to a sink water hose in a conventional manner. The pulsation selector disc 50 may be snappably attached to the downstream end 22 of the sprayer housing 12. Further, the pulsation selector disc 50 may be rotated so that the pulsation selector disc hole 64 is aligned selectively with either the upper 30 or lower 32 outlet ports. The rotor disc 70 may be mounted to the shaft 28 that extends from the sprayer housing 12 through the center of the pulsation selector disc 50. The pattern selector disc 80 may then be snappably coupled to the pulsation selector disc 50 and rotated to select a desired water pattern. Then, a desired cleaning attachment may be releasably coupled to the pattern selector disc hub 90. Of course, water flow is actuated by operation of the trigger handle 40. As water flows through a selected cleaning attachment, the user may firmly press the attachment against the surface to be cleaned. Therefore, the multi-function sink water spraying apparatus enables a user to utilize many combinations of pulsation, water patterns, and cleaning attachment configurations for a variety of cleaning situations.

In another embodiment (not shown), the sprayer housing may include only a single channel extending between the inlet port and a single outlet port. In this embodiment, some or all of the selector discs may be utilized. In this embodiment, the pulsation selector disc 50 would select between pulsation flow or no flow. However, this more simplified embodiment would enable the pattern selector disc 80 to be releasably coupled directly to the downstream end of the sprayer housing 12 and the pulsation selector disc 50 and rotor disc 70 could be omitted, if desired.

In still another embodiment (not shown), it is contemplated that the rotor disc 70 may include a hub so that an auxiliary cleaning attachment may be connected thereto. Therefore, the pulsation selector disc 50, rotor disc 70, and auxiliary cleaning attachment may be utilized in combination without using the pattern selector disc 80.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A multi-function sink water spraying apparatus for attachment to a sink water sprayer hose connected to a water supply, said water spraying apparatus comprising:

a sprayer housing defining an interior space and having a channel extending therethrough between upstream and downstream ends, said channel having an inlet port for connection to the sink water sprayer hose and having an outlet port;

a pattern selector disc rotatably coupled to said downstream end of said sprayer housing, said pattern selector disc defining a plurality of nozzle ports with each of said plurality of nozzle ports having a configuration different from a configuration of another of said plurality of nozzle ports, whereby said pattern selector disc may be rotated such that a selected nozzle port is in fluid communication with said outlet port of said channel;

a pulsation selector disc rotatably coupled to said downstream end of said sprayer housing and positioned intermediate said pattern selector disc and said downstream end, said pulsation selector disc defining a hole adapted to be selectively aligned with said outlet port of said channel for fluid communication therewith, said pattern selector disc being releasably coupled to said pulsation selector disc;

a shaft fixedly attached to said downstream end of said sprayer housing and extending through an axial bore defined by said pulsation selector disc;

a rotor assembly releasably connected to a free end of said shaft, said rotor assembly being situated in an interior space of said pattern selector disc and adapted to be sandwiched between said pulsation selector disc and said plurality of nozzle ports of said pattern selector disc for receiving a water stream flowing through said pulsation selector disc hole, said rotor assembly including means for repetitively interrupting and permitting the water stream; and an auxiliary cleaning attachment releasably coupled to said pattern selector disc.

2. The water spraying apparatus as in claim 1, further comprising:

a trigger coupled to said sprayer housing and movable between a released configuration and a depressed configuration; and a valve positioned internally within said channel and coupled to said trigger, said valve having an open configuration when said trigger is at said depressed configuration and said valve having a closed configuration when said trigger is at said released configuration.

3. The water spraying apparatus as in claim 2 wherein said trigger includes a compression spring that normally urges said trigger toward said released configuration and which is compressed when said trigger is moved to said depressed configuration.

4. The water spraying apparatus as in claim 1 wherein said rotor assembly includes means for the water stream to bypass said pulsation assembly, whereby the water stream may be conveyed between said pulsation selector disc hole and said pattern selector disc without interruption.

5. The water spraying apparatus as in claim 1 wherein said auxiliary cleaning attachment is a brush.

6. The water spraying apparatus as in claim 1 wherein said auxiliary cleaning attachment is a scraper.

7. The water spraying apparatus as in claim 1 wherein said auxiliary cleaning attachment is a glass cleaner having an elongate shaft and a plurality of brush sets.

8. The water spraying apparatus as in claim 1 wherein said sprayer housing includes a top wall having a tapered configuration suitable for receiving a thumb of a user.

9. A multi-function sink water spraying apparatus for attachment to a sink water sprayer hose connected to a water supply, said water spraying apparatus comprising:

a sprayer housing defining an interior space and having a handle section integrally attached to a body section, said handle section having an upstream end defining an inlet port and having a main channel extending in said interior space between said inlet port and said body section, said body section having a downstream end defining upper and lower outlet ports and having upper and lower channels interconnecting said main channel and respective upper and lower outlet ports;

a pulsation selector disc rotatably mounted to said downstream end of said body section of said sprayer housing and defining a hole, said pulsation selector disc being rotatably movable between a pulsation configuration in which said hole is aligned with said upper outlet port and a standard configuration in which said hole is aligned with said lower outlet port;

a pattern selector disc rotatably coupled to said pulsation selector disc, said pattern selector disc defining a plurality of radially spaced apart nozzle ports with each of said plurality of nozzle ports having a configuration different from any other nozzle port, said pattern selector disc being rotatably movable such that a selected nozzle port is aligned with said hole of said pulsation selector disc; and an auxiliary cleaning attachment releasably coupled to said pattern selector disc.

10. The water spraying apparatus as in claim 9 further comprising:

a shaft fixedly attached to said downstream end of said body section of said sprayer housing and extending through an axial bore defined by said pulsation selector disc;

a rotor disc releasably coupled to a free end of said shaft, said rotor disc being situated in an interior space of said pattern selector disc and sandwiched between said pulsation selector disc and said plurality of nozzle ports;

a rotor chamber fixedly attached to said rotor disc and defining an inlet opening, said inlet opening being aligned with said pulsation selector disc hole when said pulsation selector disc is at said pulsation configuration, said rotor chamber defining an outlet opening such that a water stream entering said inlet opening is conveyed downstream through said outlet opening to said pattern selector disc; and a rotor mounted within said rotor chamber, said rotor having a plurality of blades adapted to repetitively interrupt the water stream flowing between said inlet and outlet openings.

11. The water spraying apparatus as in claim 9 wherein:

said pulsation selector disc is releasably coupled to said downstream end of said body section of said sprayer housing;

said pattern selector disc is releasably coupled to said pulsation selector disc;

said pattern selector disc includes a hub; and said auxiliary cleaning attachment includes a shaft adapted to be releasably coupled to said hub.

12. The water spraying apparatus as in claim 9 wherein:

said pulsation selector disc includes a radial edge having a first plurality of spaced apart nubs adapted to enhance a user's grip; and said pattern selector disc includes a radial edge having a second plurality of spaced apart nubs adapted to enhance a user's grip.

13. The water spraying apparatus as in claim 9 further comprising:

a trigger coupled to said handle section of said sprayer housing and incrementally movable between a released configuration and a depressed configuration;

a valve positioned internally within said main channel and coupled to said trigger, said valve having an open configuration when said trigger is at said depressed configuration and having a closed configuration when said trigger is at said released configuration; and wherein said trigger includes a compression spring adapted to normally urge said trigger towards said released configuration, said spring being compressed when said trigger is at said depressed configuration.

14. The water spraying apparatus as in claim 9 wherein said body section of said sprayer housing includes a top wall having an ergonomic configuration adapted to receive a thumb of a user.

15. The water spraying apparatus as in claim 9 further comprising:

a soap dispensing container releasably coupled to said auxiliary cleaning attachment; and means for selectively dispensing soap from said dispensing container.

16. The water spraying apparatus as in claim 9 wherein said auxiliary cleaning attachment is a brush.

17. The water spraying apparatus as in claim 9 wherein said auxiliary cleaning attachment is a scraper.

18. The water spraying apparatus as in claim 9 wherein said auxiliary cleaning attachment is a glass cleaning assembly having an elongate shaft and a plurality of brush sets.

19. The water spraying apparatus as in claim 10 wherein:

said pulsation selector disc is releasably coupled to said downstream end of said body section of said spraying housing;

said pattern selector disc is releasably coupled to said pulsation selector disc;

said pattern selector disc includes a hub; and said auxiliary cleaning attachment includes a shaft adapted to be releasably coupled to said hub.

* * * * *